US005780959A

United States Patent [19]

Pruvost et al.

[11] Patent Number: 5,780,959

[45] Date of Patent: Jul. 14, 1998

[54] CATHODE STRUCTURE FOR CATHODE RAY TUBE

[75] Inventors: Jean-Claude Pruvost; Jean-Rémy Adamski, both of Dijon, France

[73] Assignee: Thomson Tubes and Displays, S.A., Paris, France

[21] Appl. No.: 759,348

[22] Filed: Dec. 3, 1996

[51] Int. Cl.[6] ..... H01J 1/20

[52] U.S. Cl. ..... 313/270; 313/332; 445/36

[58] Field of Search ..... 313/270, 292, 313/310, 337, 346 DC, 346 R, 40, 41; 427/77; 445/36, 51

[56] References Cited

U.S. PATENT DOCUMENTS

| | | | |
|---|---|---|---|
| 3,906,601 | 9/1975 | Buescher et al. | 445/36 |
| 5,113,110 | 5/1992 | Jang | 313/270 |
| 5,218,263 | 6/1993 | Falce et al. | 313/270 |
| 5,402,035 | 3/1995 | Lee | 313/270 |
| 5,422,536 | 6/1995 | Hale et al. | 313/270 |

FOREIGN PATENT DOCUMENTS

| | | | |
|---|---|---|---|
| 0 534 842 | 3/1993 | European Pat. Off. | H01J 1/26 |
| 1564891 | 3/1970 | Germany . | |
| 1764047 | 4/1971 | Germany . | |

OTHER PUBLICATIONS

IEEE Transactions on Electron Devices, vol. 37, Nr. 12, pp. 2564–2567, Sakae Kimura et al., "IR–Coated Dispenser Cathode for CRT", Dec. 1, 1990.

French Search Report dated: Aug. 30, 1996.

*Primary Examiner*—Sandra L. O'Shea
*Assistant Examiner*—Michael Day
*Attorney, Agent, or Firm*—Joseph S. Tripoli; Dennis H. Irlbeck

[57] ABSTRACT

An improved cathode structure for a cathode ray tube includes a first metal tube which can receive an emission part and a heating element, a second metal tube constituting the cathode shielding, and means for retaining the first tube in position inside the second, wherein the retaining means are constituted by a single metal piece. In a preferential mode of implementation, the metal retention piece is constituted by a crown having branches extending in the direction of the axis of the crown.

1 Claim, 4 Drawing Sheets

CATHODE STRUCTURE FOR CATHODE RAY TUBE

This invention relates to a cathode structure intended to be inserted in an electron gun for a cathode ray tube.

BACKGROUND OF THE INVENTION

There is a present trend to demand cathode ray tubes of increased performance in terms of screen luminosity, service life, of lighting time and of power consumption. The majority of these parameters depend essentially upon the structure and on the type of cathode used to generate the electron beam or beams, which scan the screen of the tube. Oxide cathodes, generally used up to now, have reached their limits in view of these requirements and are being replaced by dispenser cathodes, which make it possible to reach greater current densities with higher service lives.

Dispenser cathodes operate at temperatures on the order of 1000° C.–1200° C. At these temperatures, the expansion of the constituent materials of the cathode should be minimized to obtain a good performance stability of the electron gun into which this type of cathode is inserted. Such minimization is achieved by the use of refractory materials and cathode support dimensions that limit thermal loss by conduction.

U.S. Pat. No. 4,184,100 and U.S. Pat. No. 5,218,263 illustrate two types of structures currently used to control expansion. These patents use a cathode body which is essentially cylindrical in shape, containing the emitting part at one end, and in which the heating element is housed; a thermal screen shielding, essentially cylindrical in shape, surrounding the body of the cathode; and means for supporting the cathode body inside the shielding cylinder.

The means for cathode support must be such that permits a rigid assembly, while minimizing heat loss caused by thermal conduction. The support means may be brackets made from metal strips, with a thin cross section to minimize the thermal losses, having ends that are connected on one side to the body of the cathode and on the other side to the shielding cylinder. In another mode of implementation, the brackets are punched out on the cylindrical part of the shielding so that one end remains solid with the shielding, while the other end is connected to the body of the cathode.

When the brackets are made from individual metal strips, several disadvantages are encountered. Handling is delicate due to the small dimensions of the brackets. Soldering the end of the strip to the peripheral edge of the shielding involves having this edge formed with an embossed border. The use of a strip entails great uncertainty in the positioning, in terms of height, concentricity, and perpendicularity of the body of the cathode relative to the shielding. And, the use of a strip of narrow width increases the manufacturing cost.

When the brackets are stamped directly on the shielding cylinder, it is then necessary to choose a refractory material to constitute the shielding cylinder, which use impairs the thermal performance of the shielding cylinder and thereby affects the emissivity coefficient of the cathode. Moreover, a shielding of refractory material entails a higher manufacturing cost.

The present invention provides a cathode structure that makes it possible to eliminate the disadvantages of the previously discussed structures.

SUMMARY OF THE INVENTION

An improved cathode structure for a cathode ray tube according to the present invention includes a first metal tube which can receive an emission part and a heating element, a second metal tube constituting the cathode shielding, and means for retaining the first tube in position inside the second, wherein the retaining means are constituted by a single metal piece. In a preferential mode of implementation, the metal retention piece is constituted by a crown having branches extending in the direction of the axis of the crown.

DETAILED DESCRIPTION OF THE PREFERRED EMBODIMENTS

Figure 1:
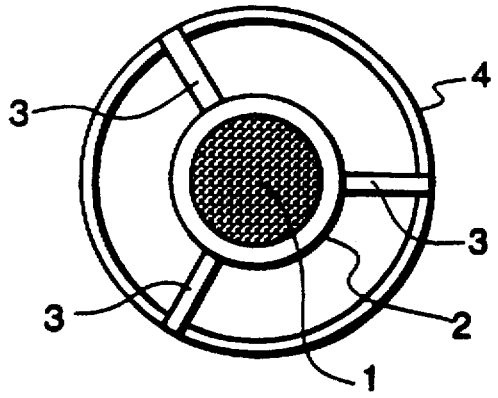
Fig. 1 PRIOR ART
FIGS. 1 and 2 are, respectively, a top view and a cutaway side view of a cathode structure according to the prior art.
Figure 2:
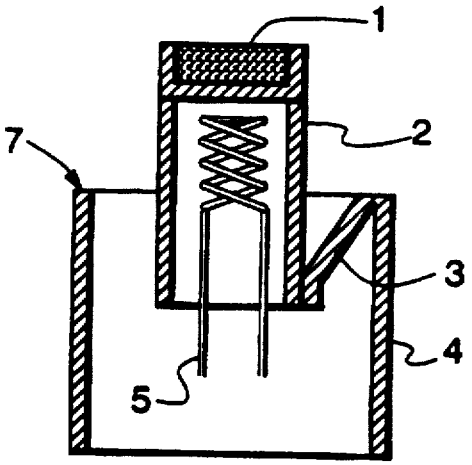
Fig. 2 PRIOR ART

As indicated in FIGS. 1 and 2, a prior art dispenser cathode structure includes a cylindrical first metal tube 2, for example of nickel chrome, at the end of which is the emitting part 1. A heating element 5 is located inside tube 2. A cylindrical second metal tube 4 surrounds the first metal tube 2 and serves as a thermal shield, to prevent the loss of heat created by the heating element 5 and to increase the thermal output of the cathode structure. The first metal tube 2 is kept in position inside the second metal tube 4 by brackets 3, stamped from a refractory material which has one of its ends soldered to the edge 7 of the second metal tube 4 and the other end to the surface of the first metal tube 2. Soldering is difficult at the edge 7, and the positioning of the tube 2 relative to the tube 4 is very delicate because of the small dimensions of the brackets 3. During the positioning of the cathode structure inside an electron gun, it is the tube 4 which serves generally as a reference, and if the first tube 2 is poorly positioned in the second tube 4, the gun and thus the tube will not operate correctly.

Figure 3:
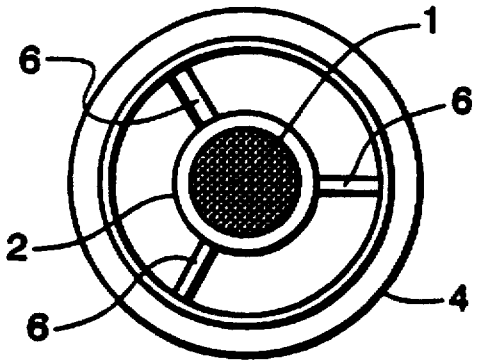
Fig. 3 PRIOR ART
FIGS. 3 and 4 are, respectively, a top view and a cutaway side view of another cathode structure contained likewise in the prior art.
Figure 4:
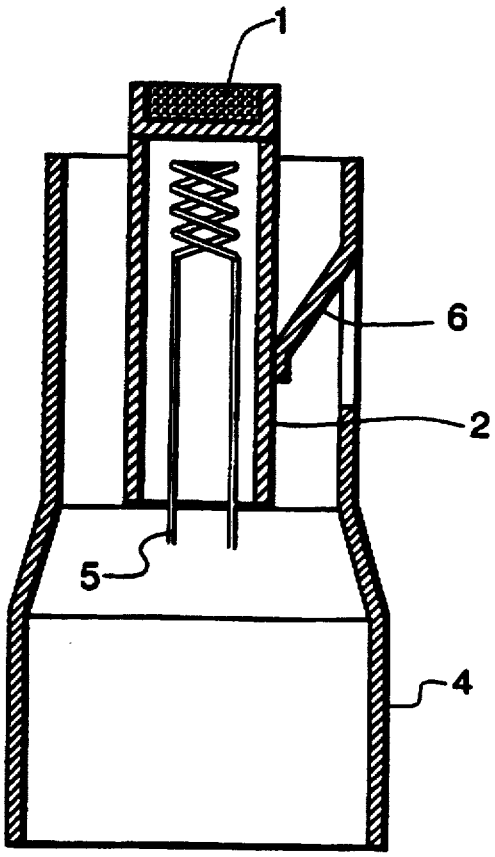
Fig. 4 PRIOR ART

In the second prior art structure illustrated in FIGS. 3 and 4, each of the brackets 6 retaining the first tube 2 is stamped directly from the cylindrical body of the second tube 4, with one end remaining as a part of the second tube. The bracket 6 extends toward the inside of the second tube 4 and its free end is soldered to the first tube 2. In this prior art embodiment case, the choice of the material constituting the second tube remains limited to refractory materials, which makes the thermal shielding less efficient and impairs the thermal output of the cathode. Moreover, the thickness and the width of the brackets are limited by the minimal thickness of the shielding (around 25–30 microns), by the access to make the soldering points and by the difficulties of stamping these materials.

Figure 5:
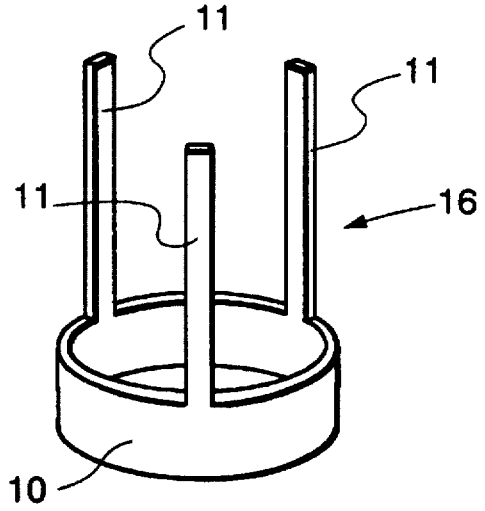
FIGS. 5 and 6 illustrate an implementation, according to the present invention, of a part for retaining one cathode tube within another tube.
Figure 6:
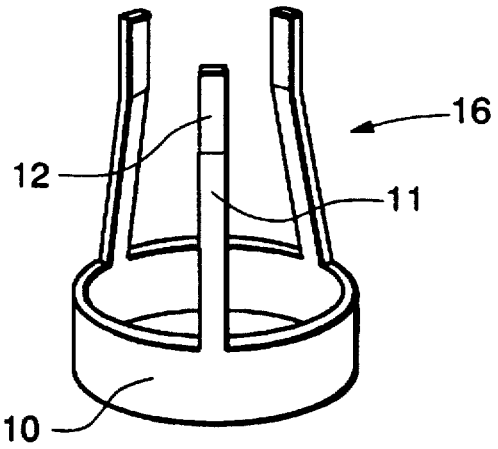
Figure 12:
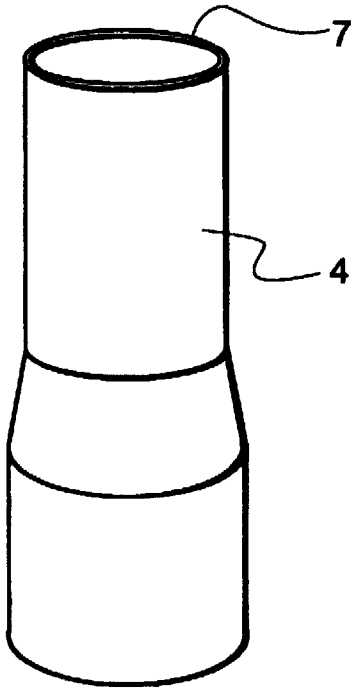

In one mode of implementation of the present invention, the first tube 2 is kept in position inside the second tube 4, shown in FIG. 12, by means of a single piece 16, shown in FIGS. 5 and 6. This single piece 16 is made from a hollow cylinder of refractory material, for example of tantalum, which is very thin, preferably from 15 to 25 microns. In this way, the thermal insulation between the cathode body and the shielding is markedly improved, thus shortening the time for bringing the cathode up to operating temperature.

Figure 7:
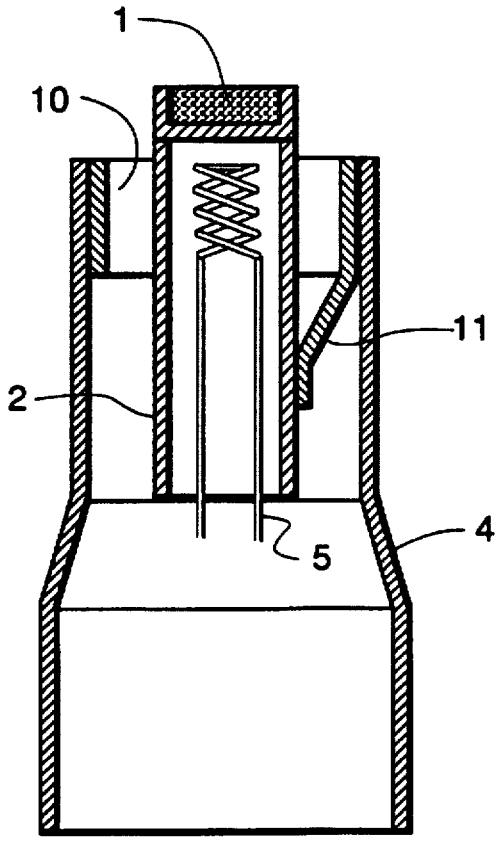
FIGS. 7 and 8 represent, respectively, a cutaway side view and a top view of a cathode structure according to the invention.
Figure 8:
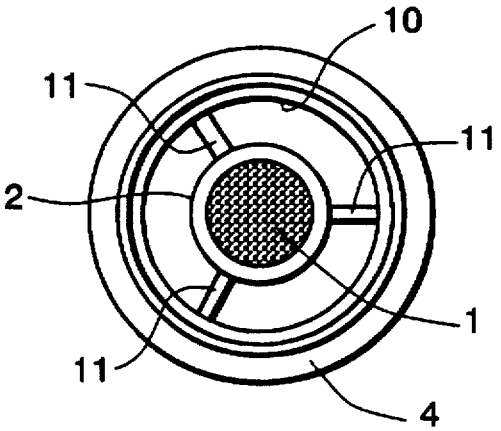
Figure 11:
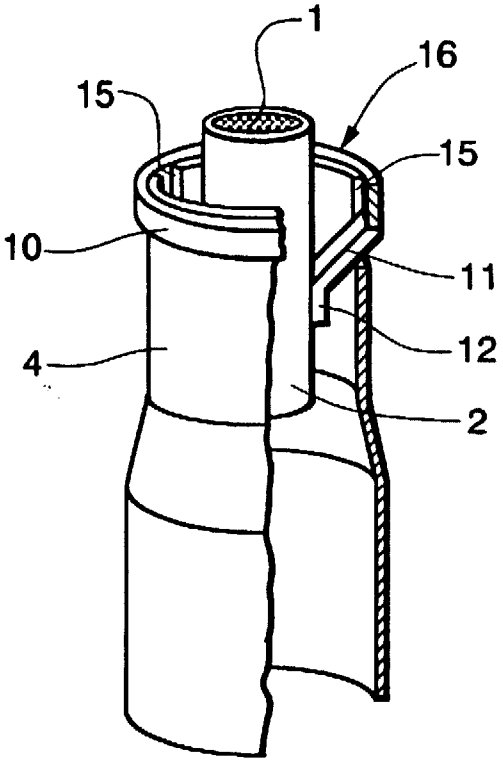
FIGS. 9, 10, and 11 represent, respectively a top view, a cutaway side view, and an exploded perspective view, of a second embodiment of a cathode structure according to the invention.
Figure 9:
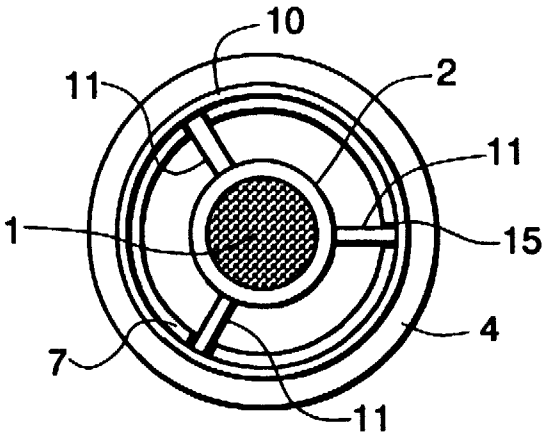
Figure 10:
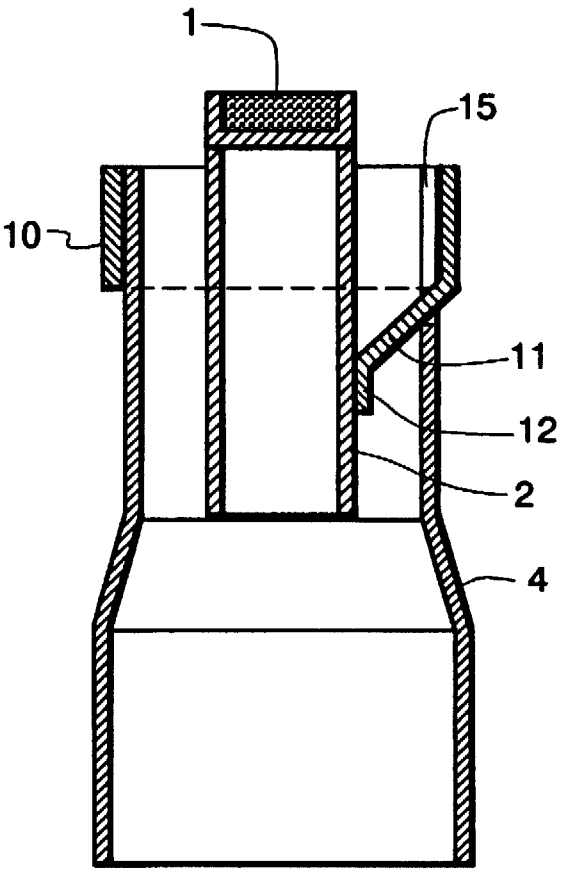
Figure 13:
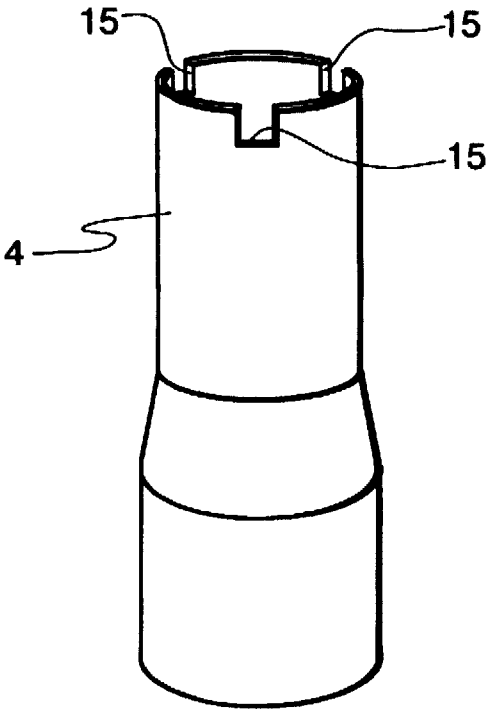
FIGS. 12 and 13 are perspective views of two shielding tubes used in cathode structures according to the invention.

The single piece 16 includes a cylindrical crown 10 with several branches 11 extending therefrom. The branches are obtained by stamping on the surface of the cylinder of refractory material from which the part is manufactured. These branches are arranged on the periphery of the crown 10 at regular intervals. To ensure a sufficiently rigid positioning, at least three branches are used, being arranged at 120° from each other. As shown in FIGS. 7 and 8, the branches extend toward the inside of the second tube 4, so that their ends 12 can be attached to the first tube 2, for example, by soldering. The final assembly of the cathode structure is then made by inserting the first tube 2 inside the second tube 4. The crown 10 has an outside diameter slightly smaller than the inside diameter of the end of the second tube 4. After relative positioning of the first tube 2 relative to the second tube 4, the crown 10 is soldered, for example, by laser welding, to the second tube 4.

In this way, it is possible to work with thinner materials than in the prior art, while having a mechanical rigidity of the support which is much greater than that of the isolated brackets of the former technique. The assembly of the cathode likewise gains in simplicity and thereby in its repeatability.

In an alternative embodiment, represented by FIGS. 9, 10, 11 and 13, the crown 10 has an inside diameter slightly greater than the outside diameter of the end of the second tube 4. The second tube 4 has notches 15 on its upper periphery permitting the passage of branches 11 inside the second tube 4, during the insertion of the first tube 2 within the second tube 4 at the final assembly of the cathode structure. This configuration has the advantage that it permits the relative positioning of the first tube 2 in relation to the second tube 4 to be done automatically, while the single piece 16 is positioned at the bottom of the notches 15. The result is a final assembly of the cathode, wherein it is no longer necessary to adjust by a delicate measuring stage the relative position of the first tube relative to the second tube. This improvement results in excellent repeatability in the relative positioning of the parts of the cathode structure.

Furthermore, use of this structure is not restricted only to dispenser cathode structures, but may also be used to obtain the same advantages in oxide cathode structures.

What is claimed is:

1. In a cathode structure for a cathode ray tube including a first metal tube adapted to receive an emitting part and a heating element, a second metal tube surrounding said first metal tube, and means for retaining the first tube positioned inside the second tube, the improvement comprising the retaining means being a single metal piece, said single metal piece including a crown having a plurality of branches extending in the direction of the axis of said crown, said crown being fixed to said second metal tube and being located on the outside surface of said second tube, and said second metal tube having perforated notches through which said branches extend toward the inside of said second tube.

* * * * *